US009874214B2

(12) United States Patent
Whitley

(10) Patent No.: US 9,874,214 B2
(45) Date of Patent: Jan. 23, 2018

(54) FAN WITH FAN BLADE MOUNTING STRUCTURE

(71) Applicant: 4Front Engineered Solutions, Inc., Carrollton, TX (US)

(72) Inventor: L. Blake Whitley, Arlington, TX (US)

(73) Assignee: 4Front Engineered Solutions, Inc., Carrollton, TX (US)

( * ) Notice: Subject to any disclaimer, the term of this patent is extended or adjusted under 35 U.S.C. 154(b) by 930 days.

(21) Appl. No.: 14/166,663

(22) Filed: Jan. 28, 2014

(65) Prior Publication Data

US 2015/0211532 A1 Jul. 30, 2015

(51) Int. Cl.

| | |
|---|---|
| ***F04D 19/00*** | (2006.01) |
| ***F04D 25/08*** | (2006.01) |
| ***F04D 29/34*** | (2006.01) |

(52) U.S. Cl.

CPC ..... *F04D 19/002* (2013.01); *F04D 25/088* (2013.01); *F04D 29/34* (2013.01); *Y10T 29/49327* (2015.01)

(58) Field of Classification Search

CPC ..... F04D 25/088; F04D 25/34; F04D 25/263; F04D 25/325; Y01T 29/49327

USPC ..... 415/119, 500

See application file for complete search history.

(56) References Cited

U.S. PATENT DOCUMENTS

| | | | |
|---|---|---|---|
| 11,629 | A | 8/1854 | Halladay |
| 871,729 | A | 11/1907 | McChord, Jr. |
| 1,041,913 | A | 10/1912 | Tyson |
| 1,379,439 | A | 5/1921 | Bott |
| 2,014,032 | A | 9/1935 | Sharpe et al. |
| 2,952,320 | A | 9/1960 | Bensen |
| 3,524,712 | A | 8/1970 | Petrie et al. |
| 1,614,186 | A | 1/1972 | Clay et al. |
| 3,721,507 | A | 3/1973 | Monteleone |

(Continued)

FOREIGN PATENT DOCUMENTS

| | | |
|---|---|---|
| DE | 3819145 | 12/1989 |
| EP | 1173359 | 1/2002 |

(Continued)

OTHER PUBLICATIONS

"The Intelligent Approach to Commercial / Industrial Ceiling Fans," Technical Guide, Commercial Industrial & Special Application Ceiling Fans, Leading Edge, A Marley Engineered Products Brand, Leading Edge 1999, 32 pages.

(Continued)

*Primary Examiner* — Kenneth Bomberg
*Assistant Examiner* — Hoon Choi
(74) *Attorney, Agent, or Firm* — Perkins Coie LLP

(57) ABSTRACT

Fans having fan blade mounting structures are disclosed herein. A fan configured in accordance with one embodiment of the present technology includes a fan having a central hub coupled to a plurality of fan blades by a plurality of blade mounting structures. Each blade mounting structure can include first and lower support members that each extend toward an inboard end portion of an individual fan blade. Each of the upper and lower support members can include a first end portion coupled to the inboard end portion of the fan blade. Each of the upper and lower support members can also include a second end portion coupled to opposite sides of the central hub.

27 Claims, 11 Drawing Sheets

(56) References Cited

U.S. PATENT DOCUMENTS 4,093,402 A 6/1978 Van Holten et al.
4,174,924 A 11/1979 Smithson, Jr.
4,248,572 A 2/1981 Fradenburgh et al.
4,324,530 A 4/1982 Fradenburgh et al.
4,334,828 A 6/1982 Moffitt et al.
4,634,341 A * 1/1987 Monroe ..... F01D 7/00 415/129
4,662,823 A 5/1987 Cooke et al.
4,722,608 A 2/1988 Salzman et al.
4,744,728 A 5/1988 Lednicer et al.
4,968,216 A 11/1990 Anderson et al.
4,975,022 A 12/1990 Perry et al.
5,213,476 A 5/1993 Monroe
5,226,783 A 7/1993 Mita et al.
5,320,494 A 6/1994 Reinfelder et al.
5,348,253 A 9/1994 Gratzer
5,564,901 A 10/1996 Moore et al.
5,601,409 A 2/1997 Huang et al.
5,725,355 A 3/1998 Crall et al.
5,785,282 A 7/1998 Wake et al.
5,823,480 A 10/1998 La Roche
5,860,788 A 1/1999 Sorensen et al.
5,885,059 A 3/1999 Kovalsky et al.
5,927,948 A 7/1999 Perry et al.
5,992,793 A 11/1999 Perry et al.
6,039,541 A 3/2000 Parker et al.
6,106,235 A 8/2000 Tettenborn et al.
6,109,874 A 8/2000 Steiner et al.
6,161,797 A 12/2000 Kirk et al.
6,244,821 B1 6/2001 Boyd et al.
6,315,522 B1 11/2001 Yamakawa et al.
6,334,705 B1 1/2002 Weetman et al.
6,431,498 B1 8/2002 Watts et al.
6,517,315 B2 2/2003 Belady et al.
6,565,320 B1 5/2003 Surls et al.
6,589,016 B2 * 7/2003 Boyd ..... F04D 25/088 416/1
6,719,533 B2 4/2004 Bird
6,776,578 B2 8/2004 Belady
6,817,835 B2 11/2004 Boyd et al.
6,884,034 B1 4/2005 Parker et al.
6,939,108 B2 9/2005 Boyd
6,976,829 B2 12/2005 Kovalsky et al.
7,128,536 B2 * 10/2006 Williams ..... F01D 5/16 416/229 R
7,246,998 B2 7/2007 Kovalsky et al.
7,252,478 B2 8/2007 Aynsley
7,284,960 B2 10/2007 Aynsley
D587,799 S 3/2009 Oleson
D607,988 S 1/2010 Oleson et al.
7,654,798 B2 2/2010 Aynsley
7,658,232 B2 2/2010 Anderson et al.
7,726,945 B2 * 6/2010 Grant ..... F04D 25/088 416/134 R
D631,536 S 1/2011 Wiegel et al.
D635,237 S 3/2011 Fizer
7,934,907 B2 5/2011 Aynsley et al.
7,955,055 B1 6/2011 Boyd et al.
D641,075 S 7/2011 Fizer et al.
D642,674 S 8/2011 Oleson
8,066,480 B2 11/2011 Madsen
D650,893 S 12/2011 Fizer
8,075,273 B2 12/2011 Aynsley
8,079,823 B2 12/2011 Aynsley et al.
8,123,479 B2 2/2012 Klemo et al.
8,142,156 B2 3/2012 Wiegel et al.
8,147,182 B2 4/2012 Aynsley et al.
8,147,204 B2 4/2012 Scherer et al.
8,152,453 B2 4/2012 Oleson
8,162,613 B2 4/2012 Oleson et al.
D672,868 S 12/2012 Williams
D676,953 S 2/2013 Hollan et al.
D690,409 S 9/2013 Noble et al.
8,529,212 B2 9/2013 Smith et al.
D692,120 S 10/2013 Noble et al.
8,579,588 B1 * 11/2013 Boyd ..... F04D 29/34 416/204 R
8,622,712 B2 1/2014 Wiegel et al.
8,646,177 B2 2/2014 Tirumalai et al.
8,672,649 B2 3/2014 Smith et al.
D705,975 S 5/2014 Hedstrom et al.
D705,976 S 5/2014 Hedstrom et al.
8,721,305 B2 5/2014 Oleson et al.
8,753,081 B2 6/2014 Aynsley et al.
8,770,937 B2 * 7/2014 Fizer ..... F04D 25/088 416/210 R
8,770,949 B2 7/2014 Noble
8,821,126 B2 9/2014 Oleson et al.
8,842,000 B2 9/2014 Walford et al.
D717,935 S 11/2014 Strecker
D717,936 S 11/2014 Peterson
8,876,468 B2 11/2014 Aynsley et al.
8,900,041 B2 12/2014 Toy et al.
8,956,124 B2 2/2015 Boyd
D723,678 S 3/2015 Strecker et al.
9,011,099 B2 * 4/2015 Wortman ..... F01D 5/141 416/210 R
D732,657 S 6/2015 Peterson
9,192,027 B1 11/2015 Pistilli
2002/0001521 A1 1/2002 Boyd et al.
2002/0155807 A1 10/2002 Moor et al.
2002/0182071 A1 12/2002 Belady
2003/0095864 A1 5/2003 Ivanovic
2003/0095874 A1 5/2003 Tagami
2004/0063571 A1 4/2004 Kim et al.
2004/0084544 A1 5/2004 Boyd et al.
2004/0131470 A1 7/2004 Boyd
2006/0104812 A1 5/2006 Kovalsky et al.
2006/0187750 A1 8/2006 Aldrich et al.
2008/0008596 A1 1/2008 Aynsley
2008/0014090 A1 1/2008 Aynsley et al.
2008/0014092 A1 1/2008 Aynsley
2008/0193294 A1 8/2008 Grant et al.
2008/0213097 A1 9/2008 Oleson et al.
2009/0072108 A1 3/2009 Oleson
2009/0081045 A1 3/2009 Scherer et al.
2009/0097975 A1 4/2009 Aynsley et al.
2009/0162197 A1 6/2009 Klemo et al.
2009/0178815 A1 7/2009 Anderson et al.
2009/0208333 A1 8/2009 Smith et al.
2009/0253364 A1 10/2009 Henry
2010/0034651 A1 2/2010 Wiegel et al.
2010/0034664 A1 2/2010 Wiegel et al.
2010/0104445 A1 4/2010 Aynsley
2010/0104461 A1 4/2010 Smith et al.
2010/0247316 A1 9/2010 Aynsley et al.
2010/0278637 A1 11/2010 Oleson et al.
2010/0291858 A1 11/2010 Toy
2011/0081246 A1 4/2011 Aynsley et al.
2011/0156002 A1 6/2011 Leatherdale et al.
2011/0262278 A1 10/2011 Fizer et al.
2012/0128501 A1 5/2012 Hoofard et al.
2012/0177500 A1 7/2012 Oleson et al.
2012/0177509 A1 7/2012 Aynsley et al.
2013/0189104 A1 * 7/2013 Hollan ..... F04D 29/329 416/135
2013/0189109 A1 7/2013 Noble
2013/0251522 A1 9/2013 Oleson
2014/0023507 A1 1/2014 Smith et al.
2014/0072431 A1 3/2014 Smith et al.
2014/0093385 A1 4/2014 Boyd et al.
2014/0286779 A1 9/2014 Aynsley et al.
2014/0348649 A1 11/2014 Oleson
2015/0023802 A1 1/2015 Oleson
2015/0037164 A1 2/2015 Fizer et al.
2015/0078902 A1 3/2015 Fizer et al.
2015/0086383 A1 3/2015 Toy
2015/0147188 A1 5/2015 Danielsson

(56) References Cited

U.S. PATENT DOCUMENTS

| | | | |
|---|---|---|---|
| 2015/0260199 | A1 | 9/2015 | Hollan |
| 2016/0290357 | A1 | 10/2016 | Whitley et al. |

FOREIGN PATENT DOCUMENTS

| | | | | |
|---|---|---|---|---|
| EP | 1619391 | | 1/2006 | |
| EP | 2271408 | | 1/2011 | |
| EP | 2397783 | A1 * | 12/2011 | ..... F24F 7/007 |
| GB | 100134 | | 3/1917 | |
| GB | 946794 | | 1/1964 | |
| GB | 2050530 | | 1/1981 | |
| GB | 2198190 | | 6/1988 | |
| WO | 200049342 | | 8/2000 | |
| WO | 2006022812 | | 3/2006 | |
| WO | 2008097735 | | 8/2008 | |
| WO | 2009011933 | | 1/2009 | |
| WO | 2009038988 | | 3/2009 | |
| WO | 2009049052 | | 4/2009 | |
| WO | 2009091443 | | 7/2009 | |
| WO | 20100019472 | | 2/2010 | |
| WO | 2011041220 | | 4/2011 | |
| WO | 2011133419 | | 10/2011 | |
| WO | 2011138626 | | 11/2011 | |
| WO | 2013109711 | | 7/2013 | |
| WO | 2013112721 | | 8/2013 | |
| WO | 2014070747 | | 5/2014 | |
| WO | 2014071046 | | 5/2014 | |
| WO | 2014190285 | | 11/2014 | |
| WO | 2015031322 | | 3/2015 | |
| WO | 2015142871 | | 9/2015 | |
| WO | 2015153604 | | 10/2015 | |
| WO | 2015168127 | | 11/2015 | |

OTHER PUBLICATIONS 747-400, Screenshot from http://www.boeing.com/commercial/747family/pf/pf_exterior.html; printed on Jul. 30, 2012, 1 page.
Advanced Blended Winglets, page last updated Feb. 6, 2004, The 737 Information Site, http://www.b7s7.org.uk Chris Brady 1999, 9 pages.
Airmotion Sciences, Inc., AirMotion™ AltAir™ eBrochure, 2010, 20 pages.
Airmotion Sciences, Inc., AirMotion™ Big Smart Fans™ 12-ft, Specifications Sheet, 2012, 1 page.
Airmotion Sciences, Inc., AirMotion™ Big Smart Fans™ 15-ft, Specifications Sheet, 2012, 1 page.
Airmotion Sciences, Inc., AirMotion™ Big Smart Fans™ 9-ft, Specifications Sheet, 2012, 1 page.
Airmotion Sciences, Inc., AirMotion™ Big Smart Fans™ for Agricultural Facilities, flyer, 2 pages.
Airmotion Sciences, Inc., What Is Heat DeStratification, and How AirMotion™ Big Smart Fans™ Help Reduce Heating costs, 2010, 1 page.
AirMotion™ AltAir™ The next Generation High Volume-Low Speed (HVLS) Fans, User Manual, © AirMotion Sciencies, Inc. 2010, 10 pages.
Big Ass Fans Installation Guide Powerfoil X, Oct. 2009, 2 pages.
Boeing 747-400 Twin-Aisle Jet Airliner, USA Screenshot from http://www.aerospacetechnology.com/projects/747/7473.html, printed on Jul. 30, 2012, 1 page.
Dairy Notes; University of California Cooperative Extension (May 1999), 5 pages.
Fairbank, "A Large Paddle Fan for Livestock Cooling" American Society of Agricultural Engineers, Jun. 1989, 16 pages.
Fan Brochure, Rite-Hite Fans, HVLS FANS, Date PDF Created: Aug. 31, 2010; 12 pages.
General Exterior Arrangement 737, Screenshot from http://www.boeing.com/commercial/737family/pf/pf_exterior.html, printed on Jul. 30, 2012, 1 page.
Image: Winglet and nav light arp.jpg, Screenshot from http://en.wikipedia.org/wiki/Image:Winglet_and_nav_light_arp.jpg; printed on Aug. 11, 2008.
Jain et al., "Experimental Investigation of the Flow Field of a Ceiling Fan," ASME Heat Transfer/Fluids Engineering Summer Conference, Paper No. HT-FED-2004-56226 (Jul. 2004) Abstract Only, 1 page.
KC-135A in flight—closeup of winglet with attached tufts, Screenshot from http://www.dfrc.nasa.gov/gallery/Photo/KC-135/Small/EC79-11481.jpg; Dated: 1979, 1 page.
KC-135A in flight-wing let study, EC79-11314, Screenshot from http://www.dfrc.nasa.gov/gallery/Photo/KC-135/Small/EC79-11314; Dated: 1979, 1 page.
KC-135A in flight-wing let study, EC79-11484, Screenshot from http://www.dfrc.nasa.gov/gallery/Photo/KC-135/Small/EC79-11484; Dated: 1979, 1 page.
Montoya, L.C.; KC-135 Winglet Flight Results, NASA Dryden Flight Research Center, pp. 145-156, 12 pages.
NASA Dryden Technology Facts—Winglets, Screenshot from http://www.nasa.gov/centers/dryden/about/Organizations/Technology/Facts/TF-2004-15-D; printed on Jul. 30, 2012, 1 page.
Next-Generation 737 Production Winglets, © Boeing, Jun. 5, 2004 snapshot of http://www.boeing.com/commercial/737family/pf/pf_winglets.html through waybackmachine Internet Archive.
Rite Hite Fan Commander Touch Screen; Date PDF created: Aug. 27, 2010; 2 pages.
Rite Hite Fans Revolution Installation and Owner's Manual, Jul. 2010, 2 pages.
Screenshots from www.b737.org.uk, relating to winglets, printed Jul. 2012, 11 pages.
U.S. Appl. No. 60/892,339, filed Mar. 1, 2007, 8 pages.
U.S. Appl. No. 60/972,890, filed Sep. 17, 2007, 8 pages.
U.S. Appl. No. 60/975,230, filed Sep. 26, 2007, 11 pages.
U.S. Appl. No. 60/978,860, filed Oct. 10, 2007, 15 pages.
Winglet Detail; screenshot from http://upload.wikimedia.org/wikipedia/commons/5/53/Wingletdetail.jpg; printed on Aug. 11, 2008.
Wingtip Device; screenshot from http://en.wikipedia.org/wiki/Wingtip_device; printed on Aug. 11, 2008.

* cited by examiner

FAN WITH FAN BLADE MOUNTING STRUCTURE

TECHNICAL FIELD

The present technology relates generally to ceiling-mounted fans, and more particularly, to fan blade mounting structures for use with such fans.

BACKGROUND

High volume, low speed (HVLS) fans are large-diameter (e.g., 20 ft. diameter), ceiling-mounted fans that can be used to provide air flow in industrial and/or commercial buildings, warehouses, loading docks, etc. HVLS fans are typically suspended from the ceiling at heights from about 10 ft. to 35 ft. above the floor, and typically include a plurality of blades extending radially outwardly from a central hub. In operation, HVLS fans rotate at relatively low speeds to produce a large downdraft of air at relatively low speed to enhance the evaporative cooling effect on the skin of personnel within the airflow.

An advantage of HLVS fans is that the costs of installation and operation are often less than those of other types of air conditioning systems, such as forced air systems that provide cooling by changing the temperature of large volumes of air. A challenge, however, with current fan designs is that fan blades can deflect or "cone" at relatively higher speeds of rotation. Coning is the deflection of the set of fan blade out of the horizontal plane due to the lift encountered along the components of the blade. Coning reduces the ability of the fan to direct airflow in a direction perpendicular to the plane of the fan blades. This, in turn, reduces lift and the overall amount of air that flows directly toward the floor. These effects become more pronounced on longer fan blades because they are more flexible than shorter fan blades.

Another challenge with certain HLVS fans is that fan blade sections can have an aerodynamic center that is not aligned with the longitudinal centerline of the fan blade section. As a result, the fan blade section can encounter a differential or twisting load that twists the blade section along the longitudinal centerline. The twist of the fan blade section is more pronounced at the distal end of the blade section and can be positive or negative relative to the air flow. A positive twist can increase angle of attack and thereby increases drag. A negative twist can reduce the angle of attack and thereby reduce lift and the resultant amount of air flow. In addition to twisting loads, the fan blade sections of HLVS fan can produce a torque load that transmits through the blade section to the attachment system.

BRIEF DESCRIPTION OF THE DRAWINGS

FIG. 2B is an enlarged, cross-sectional view taken generally along line 2B-2B in FIG. 2A illustrating a hub retention feature in more detail.

DETAILED DESCRIPTION

The following disclosure describes various embodiments of HLVS fans, blade mounting structures, and related methods and systems. Certain details are set forth in the following description and in FIGS. 1-10B to provide a thorough understanding of various embodiments of the present technology. Other details describing well-known structures and systems often associated with fans, fan blades, and related assemblies and structures, however, are not set forth below to avoid unnecessarily obscuring the description of the various embodiments of the technology.

Many of the details and features shown in the Figures are merely illustrative of particular embodiments of the technology. Accordingly, other embodiments can have other details and features without departing from the spirit and scope of the present technology. In addition, those of ordinary skill in the art will understand that further embodiments can be practiced without several of the details described below. Furthermore, various embodiments of the technology can include structures other than those illustrated in the Figures and are expressly not limited to the structures shown in the Figures. Moreover, the various elements and features illustrated in the Figures may not be drawn to scale.

In the Figures, identical reference numbers identify identical or at least generally similar elements. To facilitate the discussion of any particular element, the most significant digit or digits of any reference number refer to the Figure in which that element is first introduced. For example, element 107 is first introduced and discussed with reference to FIG. 1.

Figure 1:
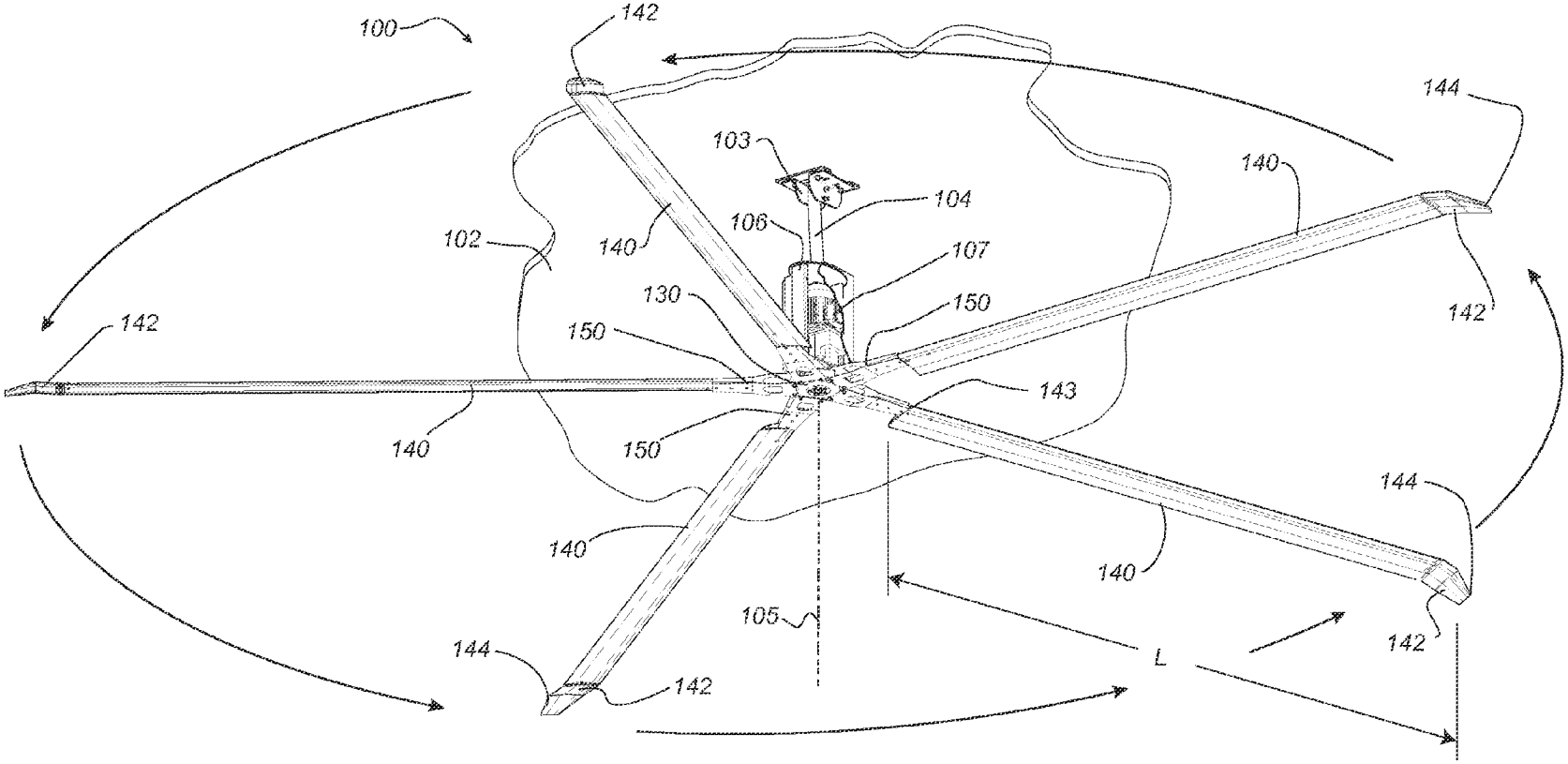
FIG. 1 is an isometric bottom view of a fan configured in accordance with an embodiment of the present technology.

FIG. 1 is an isometric bottom view of a fan 100 configured in accordance with an embodiment of the present technology. In the illustrated embodiment, the fan 100 is an HLVS fan attached to a ceiling 102 of a building by a mounting bracket 103 and a hanger 104. In some embodiments, the mounting bracket 103 is adjustable so that the fan 100 can be suspended from an angled ceiling, joist, beam, wall, etc. while remaining generally in parallel with the floor or ground (not shown). In addition, the vertical length of the hanger 104 can be selected so that the fan 100 hangs at a suitable height above the floor of the building.

The fan 100 includes a drive unit mount 106 coupled to the hanger 104. The drive unit mount 106 supports a drive unit 107 (e.g., an electric motor, engine, gear assembly or gearbox, etc.) that is operably coupled to a central fan hub 130 ("hub 130") by a drive shaft (not visible in FIG. 1). A plurality of fan blades 140 (e.g., five fan blades 140) are securely attached to the hub 130 by corresponding blade mounting structures 150. In the illustrated embodiment, the fan blades 140 extend radially outward from the mounting structures 150, and can have a length L from an inboard end portion 143 to a tip portion 144 of from about 3 ft. to about 14 ft. or more, such as from about 6 ft. to about 12 ft., or about 10 ft. In some embodiments, these blade lengths L can result in an outer diameter of the fan 100 of from about 6 ft. to about 30 ft. or more, such as from about 12 ft. to about 26 ft., or about 20 ft. to about 24 ft. In other embodiments, the fan blades 140 can have other lengths and the fan 100 can have other outer diameters.

The fan blades 140 can be formed from extruded aluminum or aluminum alloy, fabricated metal, or other suitably rigid and lightweight materials (e.g., a carbon fiber material) known in the art. In one embodiment, for example, the fan blades 140 can be made from a T6 temper aluminum alloy, such as 6061 or 6063 aluminum alloys. In the illustrated embodiment, the individual fan blades 140 have an airfoil shape with a fixed angle of attack. In some embodiments, the fan blades 140 can optionally include winglets 142 that enhance air flow at the outboard ends of the fan blades 140. In some embodiments, for example, the fan blades 140 can include winglets described in U.S. patent application Ser. No. 13/302,507, filed Nov. 22, 2011, and titled "Fan Blade Tips," which is incorporated herein in its entirety by reference. In other embodiments, the fan blades 140 can have a different shape and/or configuration, and/or a non-constant or changeable angle of attack. For example, the fan blades 140 can have a flat profile rather than an airfoil shape. Also, although the fan 100 includes five fan blades in the illustrated embodiment, in other embodiments the fan 100 can include more or fewer fan blades (e.g., ten fan blades).

In operation, the drive unit 107 rotates the fan blades 140 via the hub 130 about a central axis 105 at a rotational speed of, e.g., 10 to 100 rpm. In some embodiments, a user can control the rotational speed and/or the direction of rotation using, for example, a wall-mounted control panel and/or a wireless controller coupled to the drive unit controller (not shown) of the drive unit 107. As the fan blades 140 revolve around the central axis 105, they can produce a moving volume of air, e.g., a column of air (not shown) in a generally downward and/or upward direction, depending on the direction of rotation of the fan blades 140.

Figure 2A:
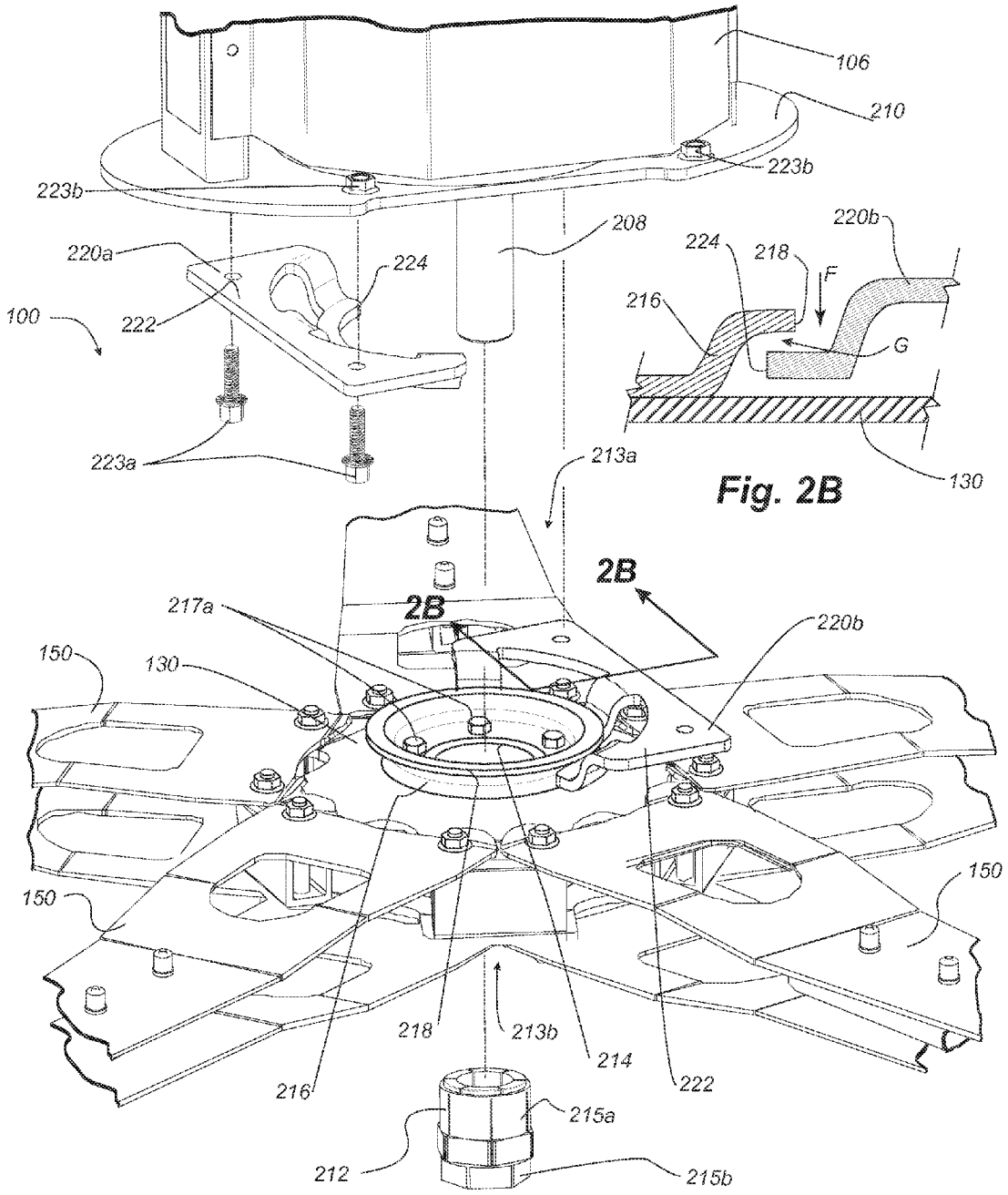
FIG. 2A is an enlarged, partially-exploded isometric top view of a fan hub configured in accordance with an embodiment of the present technology.

FIG. 2A is an enlarged, partially-exploded isometric top view of the hub 130 configured in accordance with an embodiment of the present technology. In the illustrated embodiment, the hub 130 is rotably coupled to the drive unit 107 (FIG. 1) by a drive shaft 208 that extends through a first opening (not visible) in a mounting plate 210 of the drive unit mount 106, and a second opening 214 in the hub 130. The hub 130 is secured to the drive shaft 208 by a fitting 212 (e.g., an expansion coupling) that is installed from a bottom side 213*b* of the hub 130. In the illustrated embodiment, the expansion coupling 212 includes, for example, a fenner nut assembly having an expandable member 215*a* (e.g., an expandable nut) that wedges between the drive shaft 208 and the hub 130 and threadably engages a locking member 215*b* (e.g., a bolt). The locking member 215*b* engages the expandable member 215*a* such that when installed, (i.e., when tightened), the locking member 215*b* compresses the expandable member 215*a* along its longitudinal axis. This, in turn, cause the expandable member 215*a* to expand radially between the hub 130 and the drive shaft 208 and thereby secure the hub 130 to the drive shaft 208.

Figure 3:
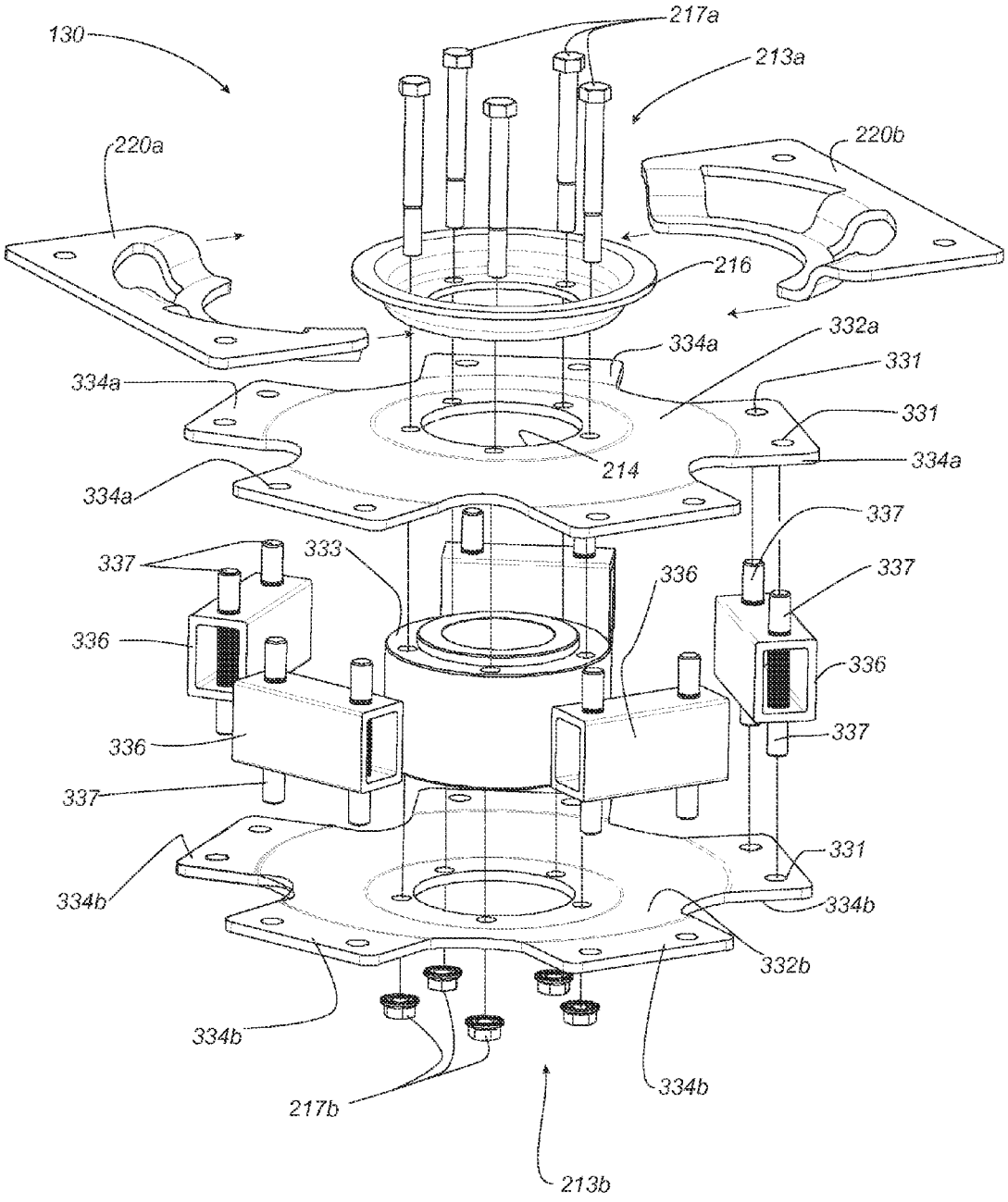
FIG. 3 is an enlarged, exploded isometric view of the central hub assembly of FIG. 2A.

In the illustrated embodiment, a retention member or ring 216 is attached to a top side 213*a* of the hub 130 by a plurality of fasteners 217*a* (e.g., hex-head bolts) that threadably engage corresponding locking features 217*b* (e.g., lock nuts; FIG. 3) toward the bottom side 213*b* of the hub 130. The retention ring 216 includes an outward flange or outer lip 218 that extends at least partially around the second opening 214. First and second retention members 220*a* and 220*b* (collectively "retention members 220") are attached to the underside of the mounting plate 210 of the drive unit mount 106. In the illustrated embodiment, each of the retention members 220 includes a mounting portion 222 and an inward flange or inner lip 224 (e.g., a flange or other suitable retaining feature) attached to the mounting plate 210 by a plurality of fasteners 223*a* (e.g., hex-head bolts) that threadably engage corresponding locking features 223*b* (e.g., lock nuts) positioned on the opposite side of the mounting plate 210. The mounting portion 222 positions the inner lip 224 so that it extends directly between the hub 130 and the outer lip 218 of the retention ring 216 and directly beneath the outer lip 218.

FIG. 2B is an enlarged, cross-sectional view taken generally along line 2B-2B in FIG. 2A, and illustrating the relationship between the retention ring 216 and the second retention member 220*b* in more detail. As this view illustrates, the retention ring 216 is vertically separated from the retention members 220 by a gap G so that the retention ring 216 is free to rotate above the inner lip 224 of the retention member 220. However, the retention ring 216 is configured to engage the retention members 220 should the hub 130 ever disengage from the drive shaft 208 in use, such as if the expansion fitting 212 broke free from the drive shaft 208 during operation. However, should the hub 130 ever disengage from the drive shaft 208 in use, such as if the expansion coupling 212 broke free from the drive shaft 208 during operation. Should this occur, the outer lip 218 of the retention ring 216 would fall onto the inner lip 224 of the individual retention members 220 (as shown by arrow F), and thus would prevent the hub 130 from falling from the drive unit mount 106. In one aspect of this embodiment, the retention members 220 can also simplify maintenance and installation of the fan 100 because they can be installed after the hub 130 is attached to the drive shaft 208. For example, the individual retention members 220 can be slid into position on opposite sides of the retention ring 216 and fastened into place without having to disconnect the hub 130 from the drive shaft 208. The retention ring 216 and the retention members 220 can also support the hub 130 during maintenance of the fan 100. For example, the retention ring 216 and the retention members 220 can hold the hub 130 when replacing the drive unit 107 and/or the drive shaft 208.

FIG. 3 is an enlarged, exploded isometric view of the hub 130 configured in accordance with an embodiment of the present technology. As shown in the illustrated embodiment, the hub 130 includes a first or upper hub plate 332*a* separated from a second or lower hub plate 332*b* (collectively "hub plates 332") by a central spacer 333 and a plurality of outer spacers 336. The central spacer 333 is securely sandwiched between the upper and lower hub plates 332*a* and 332*b* by the fasteners 217*a* and the locking features 217*b*. In this embodiment, the upper hub plate 332*a* has a plurality of first flanges 334*a* that generally define a "star" pattern toward the outer periphery of the hub 130. The lower hub plate 332*b* has a plurality of corresponding second flanges 334*b* generally aligned with the first flanges 334*a* and spaced vertically therefrom by the outer spacers 336. In the illustrated embodiment, a plurality of threaded metal studs 337 (e.g., two per outer spacer/flange combination) align and extend through the outer spacers 336 and corresponding fastener holes 331 in the mating flanges 334. As described in greater detail below, the metal studs 337 are configured to secure the individual blade mounting structures 150 (FIG. 1) to the hub plates 332.

In general, the components of the hub 130 can be formed from a variety of suitable materials known in the art, including metallic materials, using techniques such as press-forming, machining, casting, etc. For example, in some embodiments the hub plates 332, the central spacer 333, and outer spacers 336 can be made from T6 tempered aluminum alloys; and the retention ring 216 and the retention members 220 can be made from a suitable steel material (e.g., ASTM A36). Although in the illustrated embodiment the hub plates 332 have "star" shapes, in other embodiments the hub plates 332 can have different shapes, such as a round shape, pentagonal shape, etc. Also, in some embodiments the hub 130 can include integrally formed components. For example, in some embodiments the hub 130 can be a single fabricated part or unitary part (e.g. molding, casting, forging or the like), or portions of the hub 130 can be formed from a single material rather than two or more pieces fastened together.

Figure 4:
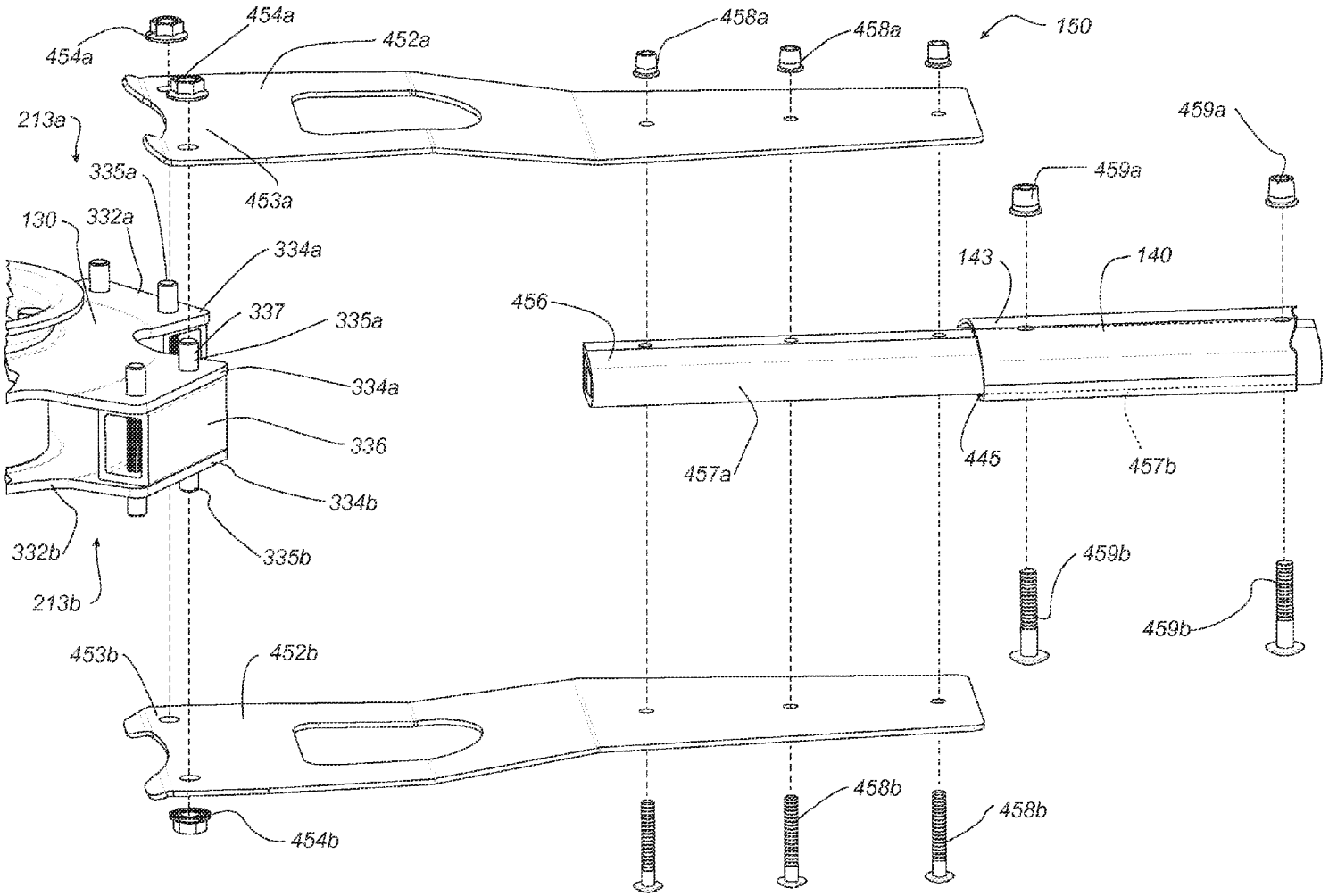
FIG. 4 is partially exploded, top isometric view of a blade mounting structure configured in accordance with an embodiment of the present technology.

FIG. 4 is partially exploded isometric view of the blade mounting structure 150 configured in accordance with an embodiment of the present technology. The blade mounting structure 150 (which can also be referred to as, e.g., a blade strut, blade support structure, truss, or framework) includes a first or upper support member 452*a* and a second or lower support member 452*b* (collectively "support members 452"). In the illustrated embodiment, the support members are flat and elongate members that extend between the hub 130 and the inboard end portion 143 of the fan blade 140. The upper support member 452*a* includes a proximal end portion 453*a* attached to the hub 130 toward the top side 213*a* by fasteners 454*a* (e.g., lock nuts) threadably engaged with first end portions 335*a* of the metal studs 337. The lower support member 452*b* similarly includes a proximal end portion 453*b* attached to the hub 130 at the bottom side 213*b* by locking features 454*b* (e.g., lock nuts) threadably engaged with opposite second end portions 335*b* of the metal studs 337. In the illustrated embodiment, the proximal end portion 453*a* of the upper support member 452*a* is attached to adjacent flanges 334*a* of the upper hub plate 332*a* and bridges therebetween, and the proximal end portion 453*b* of the lower support member 452*b* is similarly attached to the corresponding adjacent flanges 334*b* of the lower hub plate 332*b*.

In the illustrated embodiment, the blade mounting structure 150 further includes a third support member or strut 456 that couples the support members 452 to the inboard end portion 143 of the fan blade 140. The strut 456 can include, for example, an elongate shaft (e.g., a tube, beam etc.). A first portion 457*a* of the strut 456 is sandwiched between the support members 452 and attached thereto by a plurality of fasteners 458*b* (e.g., Huck fastener pins) that are threadably engaged with radial locking features 458*a* (e.g., Huck collars). A second portion 457*b* of the strut 456 (shown in hidden lines) is inserted into a cavity through an opening 445 at the inboard end portion 143. The second portion 457*b* is secured to the fan blade 140 within the cavity by a plurality of fasteners 459*b* (e.g., Huck fastener pins) that threadably engage corresponding locking features 459*a* (e.g., Huck collars). In an alternative embodiment, the second portion 457*b* of the strut 456 can be attached to an exterior portion of the fan blade 140, rather than being inserted into a cavity of the fan blade 140.

Figure 5A:
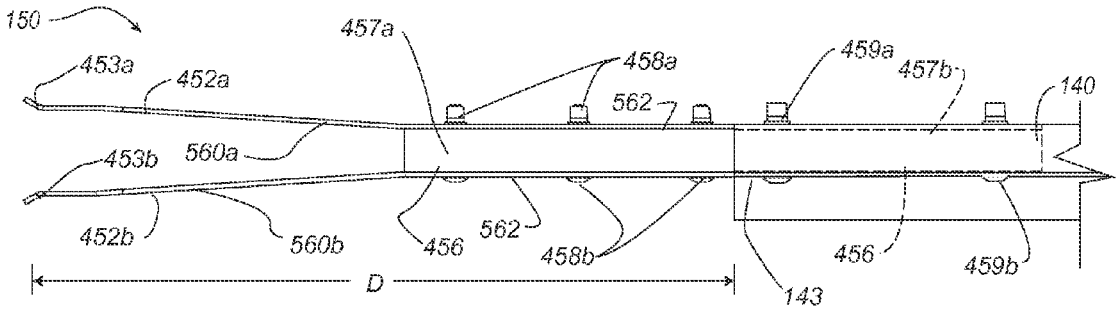
FIG. 5A is a front view and FIG. 5B is a top view of the blade mounting structure of FIG. 4.
Figure 5B:
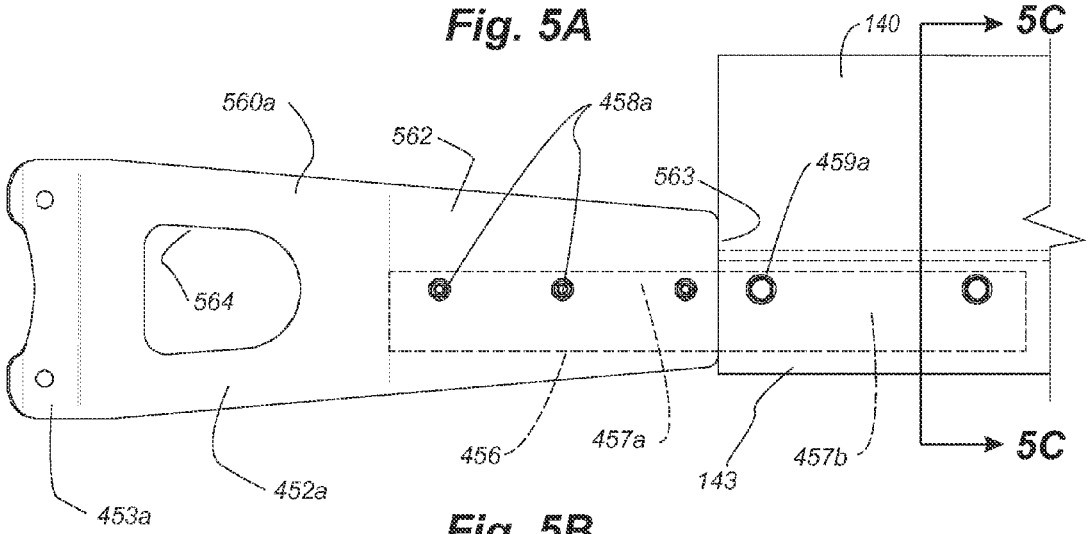

FIG. 5A is a front view, and FIG. 5B is a top view of the blade mounting structure 150 attached to the fan blade 140. Referring first to FIG. 5A, the support members 452 carry the fan blade 140 such that the inboard end portion 143 of the fan blade 140 is spaced apart from the hub 130 (FIG. 1) along the longitudinal axis of the fan blade 140. For example, the inboard end portion 143 can be offset from the outer periphery of the hub 130 by a distance D of from about, e.g., 6 inches to about 24 inches, or about 15 inches. In one embodiment, for example, the inboard end portion 143 can be offset from hub 130 by a distance D of about 15 inches.

In the illustrated embodiment, each of the support members 452 includes an angled portion 560 (identified individually as first and second angled portions 560*a* and 560*b*, respectively) and a non-angled portion 562. The first angled portion 560*a* extends generally downward from the proximal end portion 453*a* toward the strut 456. The second angled portion 560*b* extends generally upward from the proximal end portion 453*b* toward strut 456. As discussed above, the first portion 457*a* of the strut 456 is positioned between the support members 452, and the second portion 457*b* of the strut 456 (shown in hidden lines) extends into the fan blade 140 along the longitudinal axis thereof. In some embodiments, the strut 456 can have a length of from about 4 inches to about 18 inches, such as about 15 inches. In other embodiments, the strut 456 of the fan blade 140 can have other lengths, such as a quarter of the length of the fan blade 140, half the length of the fan blade, the entire length of the fan blade, etc.

Referring next to FIG. 5B, each of the support members 452 has a tapered profile that narrows or tapers inwardly as it extends from the hub 130 to the inboard end portion 143 of the fan blade 140. In the illustrated embodiment, an outboard edge 563 of each of the support members 452 can abut against the inboard end portion 143 of the fan blade 140. In other embodiments, however, the outboard edge 563 and the inboard end portion 143 can be spaced apart from each another.

In the illustrated embodiment, each of the support members 452 includes a cut-out or opening 564 generally medially disposed in the angled portions 560. The opening 564 can reduce the overall weight of the blade mounting structure 150, and can be configured to augment the vertical air flow profile of the fan 100. For example, without wishing to be bound by theory, it is believed that certain shapes and/or sizes of the openings 564 can promote uptake of air toward the center of the fan 100, i.e., when the fan blades 140 are producing a generally downward draft of air away from the center of the fan 100.

The support members 452 and the strut 456 can be formed, for example, from various suitable materials and methods, such as metals, e.g., sheet metal or metal castings, plastic molds or the like. For example, in some embodiments, the support members 452 can be laser-cut from sheet metal, such as high-strength, low-alloy steel (e.g., ASTM A572), and the strut 456 can be formed from aluminum alloy, such as T6 tempered aluminum alloy. In the illustrated embodiment, the support members 452 are identical or at least have generally the same shape and are symmetric with one another in the vertical direction about the longitudinal axis of the fan blade 140. In other embodiments, however, the support members 452 can have different shapes and/or be asymmetric. For example, in some embodiments the flanges 334 of the hub 130 can carry the support members 452 such that they are asymmetric about the longitudinal axis of the blade mounting structure 150.

Figure 5C:
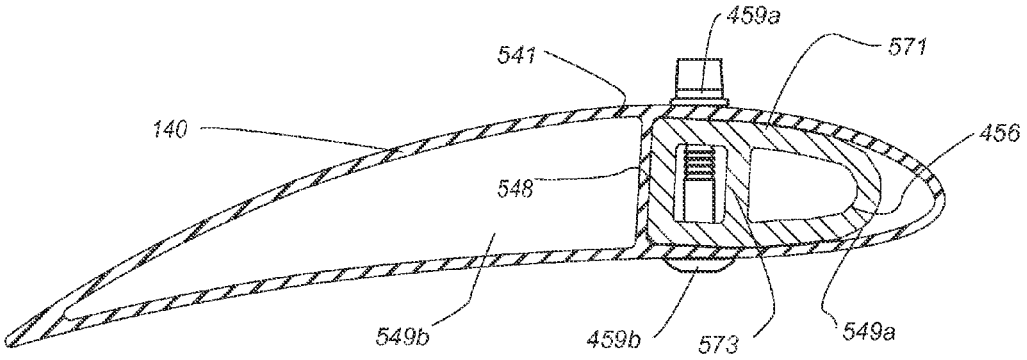
FIG. 5C is a cross-sectional end view of a portion of the blade mounting structure of FIG. 5B taken along line 5C-5C in FIG. 5B.

FIG. 5C is a cross-sectional end view of a portion of the fan blade 140 and the strut 456 taken along line 5C-5C in FIG. 5B. In the illustrated embodiment, the fan blade 140 includes a web 548 extending generally vertically along the longitudinal axis of the fan blade and separating a first leading edge or cavity 549*a* from a second trailing edge or cavity 549*b*. The web 548 can be a stiffening structure that is integrally formed with or attached (e.g., welded) to an outer wall or skin 541 of the fan blade 140. In addition to increasing the rigidity of the fan blade 140, the web 548 can also form a contoured pocket that firmly receives the snugly fitted strut 456 in the leading edge cavity 549*a*.

In the illustrated embodiment, the strut 456 has a contoured surface 571 that at least partially conforms to the shape and profile (e.g., curvature) of the leading edge cavity 549*a* to facility a snug or close fit between the strut 456 and the fan blade 140. The strut 456 can be hollow or partially hollow and include a stiffening web 573 extending along the longitudinal axis thereof. In other embodiments, the strut 456 can have other shapes and/or profiles. For example, the strut 456 can have an outer edge that does not conform or does not substantially conform to the leading edge cavity 549*a*.

Fan blades in conventional HVLS fans abut against the hub and attach to the hub with a small hub connector, such as a metal stub attached to or integrated with the hub. One shortcoming of such designs is that the long fan blades can apply relatively large loads, such as torsional loads to the hub connector, which can lead to premature wear or to damage of the hub connector. In addition, as discussed above, fan blades can apply a substantial twisting force along their longitudinal axis during operation, which can add further stress to conventional hub connectors. Further, a singular hub connector can be vulnerable to single point failure mechanisms due to the concentration of stress and other loads at this singular connection. Blade mounting structures configured in accordance with various embodiments of the present technology, such as the blade mounting structure 150, can address these and other limitations of conventional hub connectors by providing a relatively strong and stiff connection between the fan blades and the hub to reduce or eliminate the effects of coning, twisting, torsional, and/or other forces. For example, the blade mounting structures can reduce or alleviate stress at the junctions with the fasteners that attach the blade mounting structure 150 to the hub 130 and the inboard end portion 143 of the fan blade 140.

Figure 6:
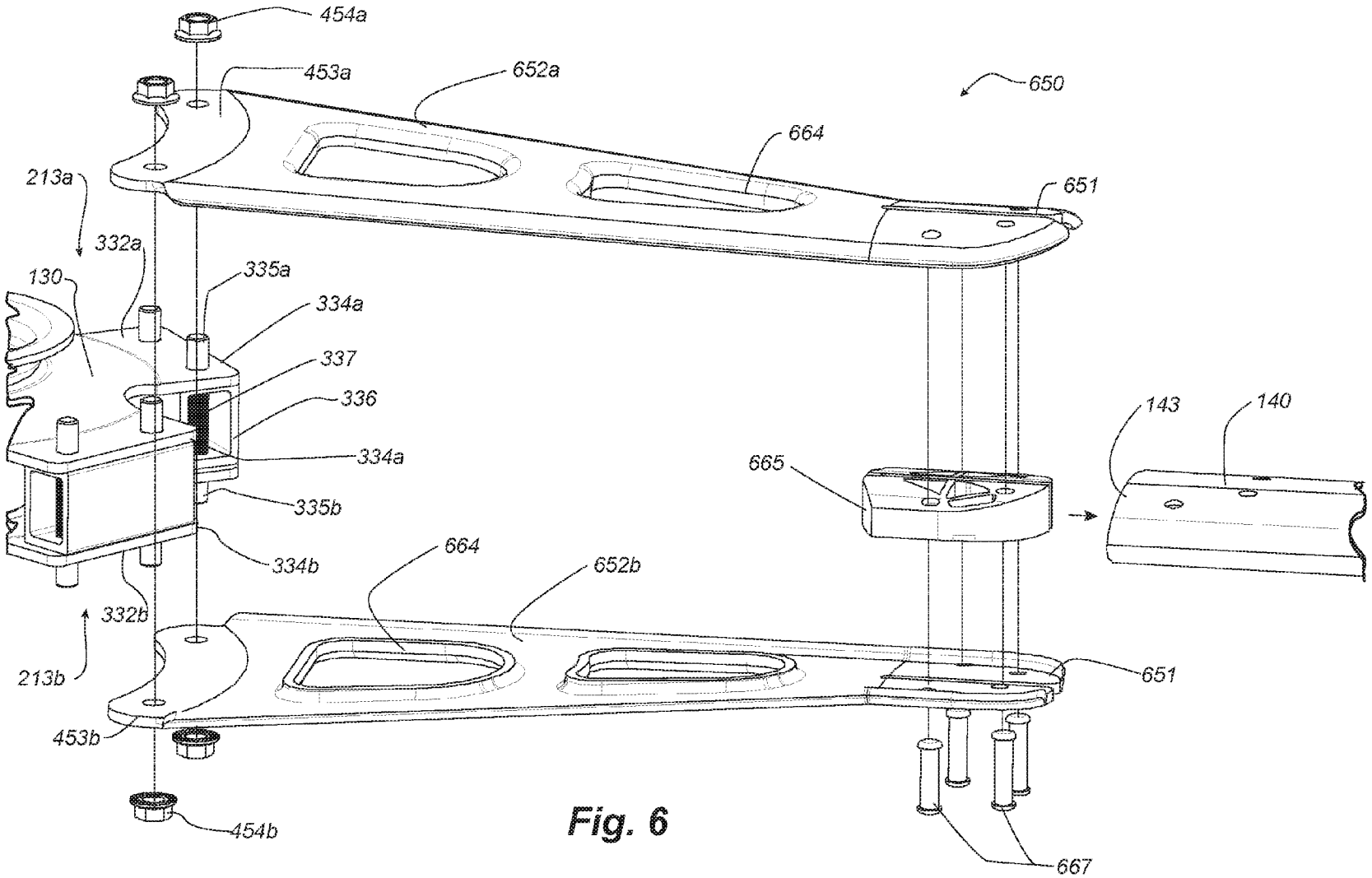
FIG. 6 is a partially exploded isometric view of a blade mounting structure configured in accordance with another embodiment of the present technology.

FIG. 6 is partially exploded isometric view of a blade mounting structure 650 configured in accordance with another embodiment of the present technology. The blade mounting structure 650 can include features generally similar in structure and function to those of the blade mounting structure 150 described in detail above with reference to FIGS. 1-5C. For example, the blade mounting structure 650 can include upper and lower support members 652*a* and 652*b* (collectively "support members 652") that are each mounted to adjacent flanges 334 of the upper and lower hub plates 332*a* and 332*b*, respectively, Similar to the support members 452 of FIG. 4, each of the support members 652 can include formed openings 664 to, e.g., reduce weight or enhance performance. In the embodiment of FIG. 6, however, a spacer insert 665 is sandwiched between distal end portions 651 of the support members 652. The end portion 651 are inserted into the inboard end portion 143 of the fan blade 140. The support members 652 are then attached to the fan blade 140 by a plurality of fasteners 667 (e.g., rivets).

Figure 7:
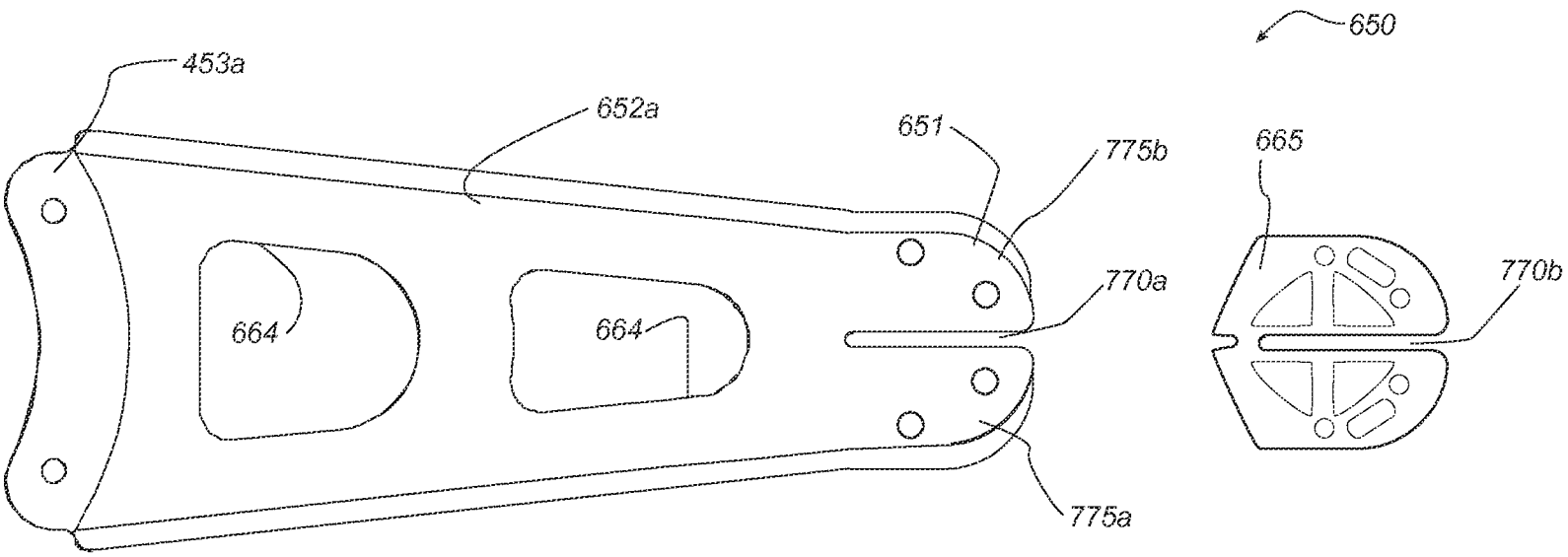
FIG. 7 is a top view of a spacer insert and a support member of the blade mounting structure of FIG. 6.
Figure 8A:
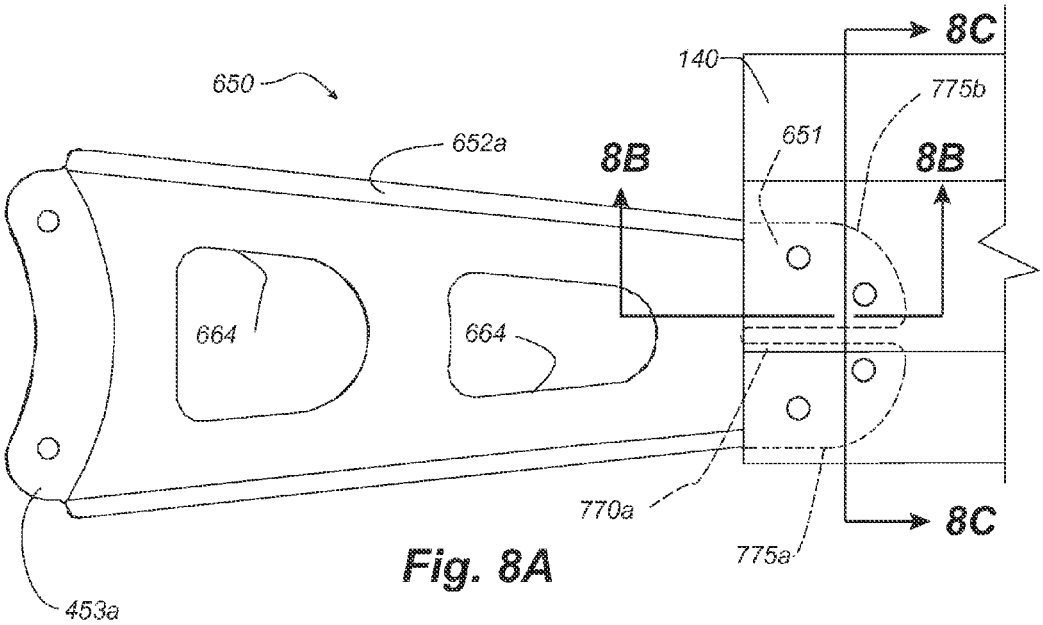
FIG. 8A is a top view of the blade mounting structure of FIG. 6, and FIGS. 8B and 8C are cross-sectional side and end views, respectively, taken along lines 8B-8B and 8C-8C in FIG. 8A, respectively.
Figure 8B:
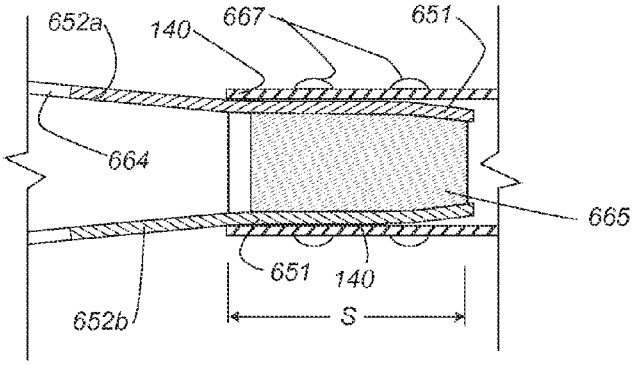
Figure 8C:
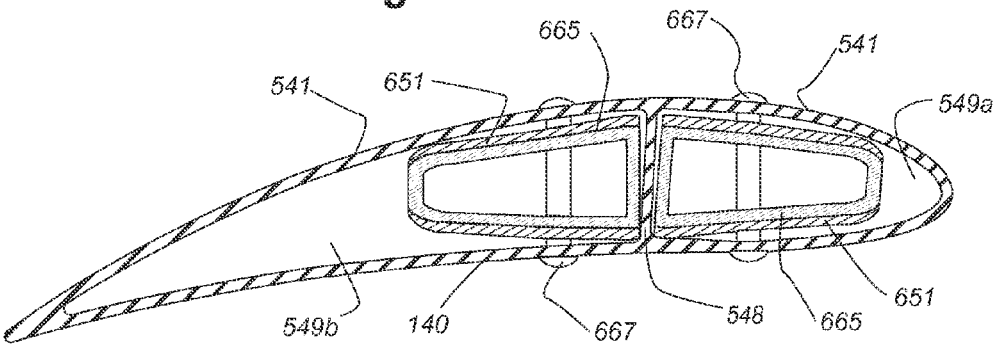

FIG. 7 is a top view of the spacer insert 665 and the support members 652 of FIG. 6. FIG. 8A is a top view of the blade mounting structure 650, and FIGS. 8B and 8C are cross-sectional side and end views, respectively, taken along lines 8B-8B and 8C-8C in FIG. 8A, respectively. Referring to FIGS. 7-8C together, the distal end portions 651 of the support members 652 include a longitudinal slot 770*a* and the spacer insert 665 includes a longitudinal slot 770*b* that receive the web 548 of the fan blade 140 (FIG. 5C) when the distal end portions 651 are inserted into the inboard end portion 143 of the fan blade 140 (FIG. 8C). In particular, a first side 775*a* of the distal end portion 651 extends into the leading edge cavity 549*a* (FIGS. 5C and 8C), and a second side 775*b* of the distal end portion 651 extends into the trailing edge cavity 549*b*. In the illustrated embodiment, the distal end portions 651 and the spacer insert 665 conform to the curved contours of the leading edge and trailing edge cavities 549*a* and 549*b* to facilitate a snug or close fit within the fan blade 140. For example, the spacer insert 665 can press the support members 652 against the inner surfaces of the leading edge and trailing edge cavities 549*a* and 549*b*. In other embodiments, however, the distal end portions 651 and/or the spacer insert 665 can have different shapes, sizes, and/or contours.

In the illustrated embodiment, the spacer insert 665 can have a longitudinal length S (FIG. 8B) from about 1 inch to about 10 inches, such as about 5 inches. The spacer insert 665 can be formed, for example, from a suitable metallic, plastic, or other material. In one embodiment, for example, the spacer insert 665 can include an extruded aluminum alloy having an at least partially hollow cavity (not shown). In another embodiment, the spacer insert 665 can include a molded plastic or cast metal. In an alternate embodiment, an epoxy or other suitable fill material can be used in lieu of the spacer insert 665 to fill the void between the distal end portions 651 of the support members 650 within the leading edge cavity 549*a* and/or the trailing edge cavity 549*b*.

Figure 9:
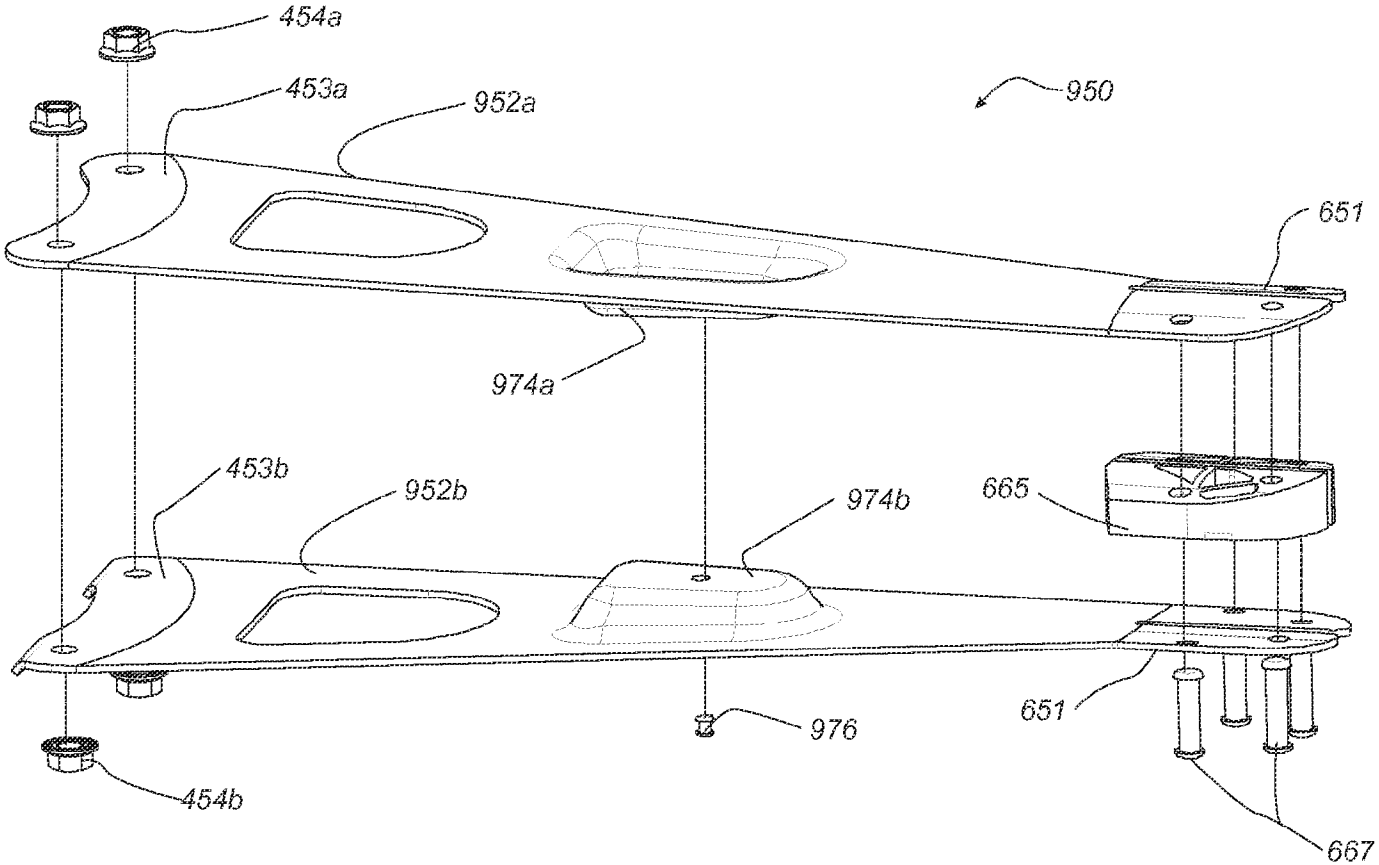
FIG. 9 is a partially exploded, top isometric view of a blade mounting structure configured in accordance with another embodiment of the present technology.

FIG. 9 is partially exploded isometric view of a blade mounting structure 950 configured in accordance with another embodiment of the present technology. The blade mounting structure 950 can include features generally similar in structure and function to those of the blade mounting structures 150 and 650 described in detail above with reference to FIGS. 1-8C. For example, the blade mounting structure 950 can include a spacer insert 665 coupled to distal end portions 651 of upper and lower support members 952*a* and 952*b* (collectively "support members 952"). In this embodiment, however, the upper support member 952*a* can include a first spacer portion 974*a* integrally formed in a medial portion therein, and the lower support member 952*b* can similarly include a second spacer portion 974*b* integrally formed in a medial portion therein. The first and second spacer portions 974*a* and 974*b* can extend generally toward each other and can be attached together by a fastener 976 (e.g., a rivet). The first and second spacer portions 974*a* and 974*b* can strengthen or enhance the rigidity of the blade mounting structure 950. In other embodiments, the spacer portions 974*a* and 974*b* can be positioned differently, such as more proximate to the hub 130. Also, the blade mounting structure 950 can include additional sets of spacer portions. For example, the blade mounting structure 950 can include two or three sets of spacer portions, with each set positioned along the longitudinal axis of the blade mounting structure 950.

Figure 10A:
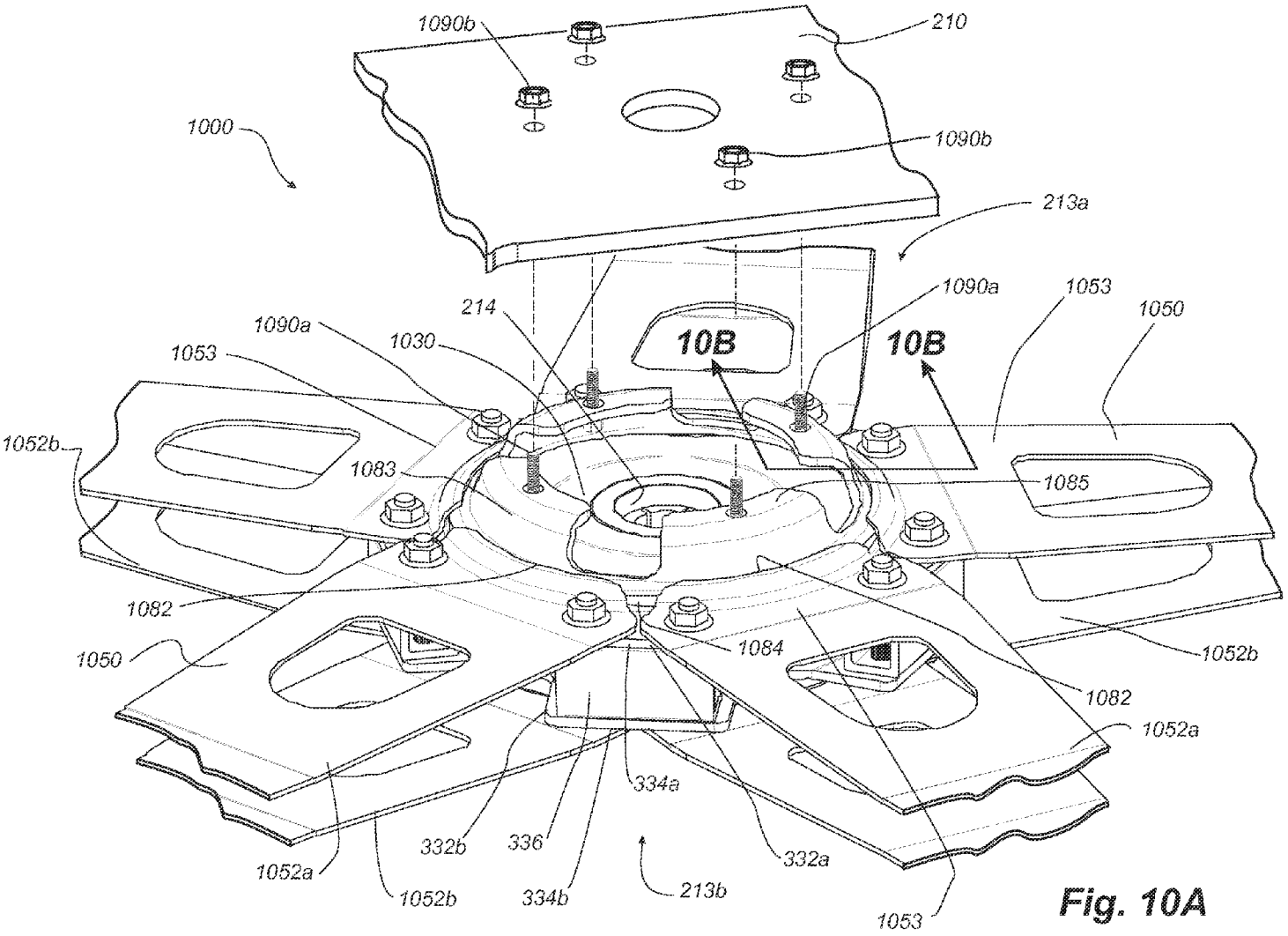
FIG. 10A is an isometric top view of a central portion of a fan having a plurality of blade mounting structures configured in accordance with another embodiment of the present technology.

FIG. 10A is an isometric top view of a central portion of a fan 1000 having a plurality of blade mounting structures 1050 coupled to a central hub 1030 in accordance with another embodiment of the present technology. The hub 1030 and the blade mounting structures 1050 can include features generally similar in structure and function to those of the hub 130 and the blade mounting structures 150, 650, and 950 described in detail above with reference to FIGS. 1-9. For example, the blade mounting structure 1050 can include upper and lower support members 1052*a* and 1052*b* having proximal end portions 1053 that attach adjacent to the hub plates 332. In the illustrated embodiment of FIG. 10A, however, each of the upper support members 1052*a* includes a raised inward flange or inner lip 1082 on the proximal end portion 1053.

In the illustrated embodiment, a retention member or ring 1083 includes a mounting portion 1085 coupled to an underside of the mounting plate 210 via a plurality of fasteners 1090*a* (e.g., hex-head bolts) that threadably engage corresponding locking features 1090*b* (e.g., locking nuts) positioned on the opposite side of the mounting plate 210. The retention ring 1083 also includes an outward flange or outer lip 1084 that extends at least partially around the second opening 214.

Figure 10B:
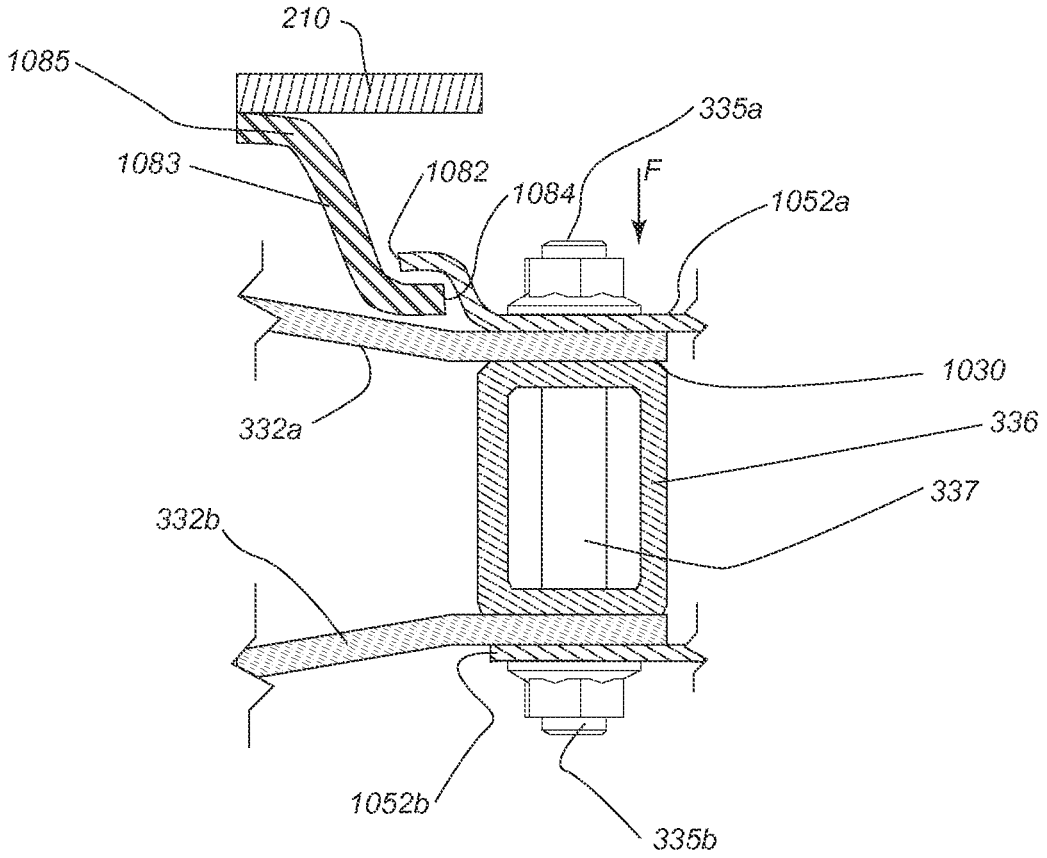
FIG. 10B is an enlarged, cross-sectional view taken generally along line 10B-10B in FIG. 10A illustrating a hub retention feature in more detail.

FIG. 10B is an enlarged, cross-sectional view taken generally along line 10B-10B in FIG. 10A, and illustrates the relationship between the retention ring 1083 and the inner lip 1082 of the upper support member 1052*a* in more detail. Similar to the retention ring 216 and the retention members 220 described above with reference to FIGS. 2A and 2B, the inner lip 1082 of the upper support member 1052*a* is configured to engage the outer lip 1084 of the retention ring 1083 should the hub 1030 ever disengage from the drive shaft 208 (FIG. 2A) in use. In particular, if this were to occur, the inner lip 1082 of the upper support member 1052*a* would fall onto the outer lip 1084 of the retention ring 1083 (as shown by arrow F), and thus would prevent the hub 1030 from falling from the mounting plate 210. In the illustrated embodiment, the inner lip 1082 of the upper support member 1052*a* is integrally formed with the upper support member 1052, and thus simplify manufacturing because it can reduce the overall number of parts of the fan 100. In other embodiments, however, the inner lip can be a separate piece that is attached to the upper support member 1052 with, e.g., a weld, fasteners, etc.

From the foregoing, it will be appreciated that specific embodiments of the present technology have been described herein for purposes of illustration, but that various modifications may be made without deviating from the spirit and scope of the various embodiments of the present technology. For example, in one embodiment a remotely positioned drive unit or engine can rotate the drive shaft 208 (FIG. 2A) with a system of one or more belts and/or pulleys. Also, while shown in the illustrated embodiment as two generally flat elongate members, in other embodiments, the support members 452, 652, 952, and/or 1052 described above with reference to FIGS. 1-10B can include more than two members and/or have different sizes, shapes, and/or profiles (e.g., non-tapered profiles). In addition, while certain types of fasteners may be illustrated for coupling components of the fan together (e.g., Huck fastener pins and collars, hex-head bolts, screws, rivets, etc.), in other embodiments, other types of fasteners known in the art can be used. Moreover, in some embodiments components can be attached to one another by other attachment techniques in addition to and/or in lieu of fasteners, such as welding, adhesives, etc. Further, while various advantages and features associated with certain embodiments of the present technology have been described above in the context of those embodiments, other embodiments may also exhibit such advantages and/or features, and not all embodiments need necessarily exhibit such advantages and/or features to fall within the scope of the present technology. Accordingly, the invention is not limited, except as by the appended claims.

I claim:

1. A fan, comprising:

a central hub having a top side and a bottom side opposite the top side;

a plurality of fan blades, wherein each of the fan blades has an inboard end portion spaced apart from a tip portion; and a plurality of blade mounting structures, wherein each of the blade mounting structures couples a corresponding one of the fan blades to the central hub, and wherein each of the blade mounting structures includes— a strut having a first portion and a second portion, wherein the second portion of the strut is inserted into the corresponding fan blade:

a first support member having a first end portion coupled to the central hub proximate the top side and a second end portion coupled to the first portion of the strut; and a second support member having a first end portion coupled to the central hub proximate the bottom side and a second end portion coupled to the first portion of the strut, wherein the first end portion of the first support member is spaced apart from the first end portion of the second support member to define a space therebetween, and wherein the central hub is disposed in the space between the first end portion of the first support member and the first end portion of the second support member.

2. The fan of claim 1 wherein the first portion of the strut is sandwiched between the first and second support members.

3. The fan of claim 1 wherein the first and second support members are vertically spaced apart from one another.

4. The fan of claim 1 wherein the central hub includes:

a first hub plate; and a second hub plate spaced apart from the first hub plate, wherein the first support member is attached to the first hub plate, and wherein the second support member is attached to the second hub plate.

5. The fan of claim 1 wherein the first support member of each of the blade mounting structures has generally the same shape and size as the second support member, and wherein the first and second supports members of each of the blade mounting structures are generally symmetric about a longitudinal axis of the fan blade.

6. A fan, comprising:

a central hub having a top side and a bottom side opposite the top side;

a plurality of fan blades, wherein each of the fan blades has an inboard end portion spaced apart from a tip portion, and wherein each of the fan blades further includes a cavity extending along a longitudinal axis; and a plurality of blade mounting structures, wherein each of the blade mounting structures extends at least partially into the cavity of a corresponding one of the fan blades and couples the corresponding fan blade to the central hub, and wherein each of the blade mounting structures includes— a first support member having a first end portion coupled to the central hub proximate the top side and a second end portion coupled to the inboard end portion of the corresponding fan blade; and a second support member having a first end portion coupled to the central hub proximate the bottom side and a second end portion coupled to the inboard end portion of the corresponding fan blade, wherein the first end portion of the first support member is spaced apart from the first end portion of the second support member to define a space therebetween, and wherein the central hub is disposed in the space between the first end portion of the first support member and the first end portion of the second support member.

7. The fan of claim 6 wherein each of the blade mounting structures includes a spacer sandwiched between the first and second support members, and wherein the spacer is at least partially disposed within the cavity.

8. The fan of claim 6 wherein:

the first support member includes at least one spacer portion; and the second support member includes at least one spacer portion.

9. The fan of claim 8 where the at least one spacer portion of the first support member is attached to the at least one spacer portion of the second support member.

10. A fan, comprising:

a central hub having a too side, a bottom side opposite the top side, and a drive shaft opening extending therethrough;

a first retention member attached to the central hub and at least partially surrounding the drive shaft opening, wherein the first retention member includes a first flange;

a drive unit mount;

at least two second retention members attached to the drive unit mount, wherein each of the second retention members at least partially surrounds the drive shaft opening, and wherein each of the second retention members includes a second flange that extends between the central hub and the first flange of the first retention member;

a plurality of fan blades, wherein each of the fan blades has an inboard end portion spaced apart from a tip portion; and a plurality of blade mounting structures, wherein each of the blade mounting structures couples a corresponding one of the fan blades to the central hub, and wherein each of the blade mounting structures includes— a first support member having a first end portion coupled to the central hub proximate the top side and a second end portion coupled to the inboard end portion of the corresponding fan blade; and a second support member having a first end portion coupled to the central hub proximate the bottom side and a second end portion coupled to the inboard end portion of the corresponding fan blade, wherein the first end portion of the first support member is spaced apart from the first end portion of the second support member to define a space therebetween, and wherein the central hub is disposed in the space between the first end portion of the first support member and the first end portion of the second support member.

11. The fan of claim 10 wherein the blade mounting structure further includes a strut, the strut having:

a first portion attached to the first and second support members; and a second portion attached to the inboard end portion of the fan blade.

12. The fan of claim 10 wherein the first flange is an outward flange and the second flange is an inward flange.

13. The fan of claim 10 wherein the first flange extends in a first direction and the second flange extends in a second direction, opposite to the first direction.

14. A fan, comprising:

a central hub having a top side and a bottom side opposite the top side, wherein the central hub includes a drive shaft opening extending therethrough;

a plurality of fan blades, wherein each of the fan blades has an inboard end portion spaced apart from a tip portion;

a plurality of blade mounting structures, wherein each of the blade mounting structures couples a corresponding one of the fan blades to the central hub, and wherein each of the blade mounting structures includes— a first support member having a first end portion coupled to the central hub proximate the top side and a second end portion coupled to the inboard end portion of the corresponding fan blade, wherein the first support member further includes an inward lip integrally formed with the first support member, and wherein the inward lip extends radially toward the shaft opening; and a second support member having a first end portion coupled to the central hub proximate the bottom side and a second end portion coupled to the inboard end portion of the corresponding fan blade;

a drive unit mount; and at least one retention member attached to the drive unit mount and at least partially surrounding the drive shaft opening, wherein the at least one retention member includes an outward flange, and wherein the outward flange extends between the central hub and the inward lip of the first support member.

15. The fan of claim 14 wherein the inward lip of the first support member is aligned with a longitudinal axis of the first support member.

16. A fan comprising:

a drive unit having a drive shaft;

a drive unit mount carrying the drive unit; and a central hub coupled to the drive shaft;

means for holding the central hub to the drive unit mount in the event that the central hub becomes decoupled from the drive shaft, a plurality of fan blades, wherein each fan blade has an inboard end portion spaced apart from the central hub and a tip portion spaced apart from the inboard end portion; and means for coupling each of the fan blades to the central hub, wherein the means for coupling includes— an upper support member having a first end portion coupled to the central hub and a second end portion coupled to a corresponding one of the fan blades; and a lower support member having a first end portion coupled to the central hub and a second end portion coupled to the corresponding one of the fan blades, wherein the central hub is positioned between the first end portion of the upper support member and the first end portion of the lower support member.

17. The fan of claim 16, further comprising means for spacing the upper support member apart from the lower support member.

18. The fan of claim 16 wherein the means for coupling each of the fan blades to the central hub further includes a strut having:

a first portion attached to the upper and lower support members; and a second portion attached to the inboard end portion of the fan blade.

19. The fan of claim 16 wherein the upper support member is spaced apart from the lower support member to define an open space therebetween.

20. A method of manufacturing a fan, the method comprising:

positioning an outer portion of a central hub between an upper support member and a lower support member, wherein the central hub includes a top side facing a first direction and a bottom side facing a second direction, opposite to the first direction;

attaching a proximal end portion of the upper support member to the top side of the central hub;

attaching a proximal end portion of the lower support member to the bottom side of the central hub;

coupling an inboard end portion of a fan blade to a distal end portion of the upper support member, wherein coupling the inboard end portion of the fan blade to the distal end portion of the upper support member includes at least partially inserting the distal end portion of the upper support member through an opening and into a cavity in the inboard portion of the fan blade; and coupling the inboard end portion of the fan blade to a distal end portion of the lower support member, wherein coupling the inboard end portion of the fan blade to the distal end portion of the lower support member includes at least partially inserting the distal end portion of the lower support member through the opening and into the cavity in the inboard portion of the fan blade.

21. A method of manufacturing a fan, the method comprising:

positioning an outer portion of a central hub between a proximal end portion of an upper support member and a proximal end portion of a lower support member, wherein the central hub includes a top side facing a first direction and a bottom side facing a second direction, opposite to the first direction;

attaching the proximal end portion of the upper support member to the top side of the central hub;

attaching the proximal end portion of the lower support member to the bottom side of the central hub;

coupling a distal end portion of the upper support member to a first end portion of a strut;

coupling a distal end portion of the lower support member to the first end portion of the strut; and inserting a second end portion of the strut through an opening and into a cavity in an inboard end portion of a fan blade, wherein the first end portion of the strut is sandwiched between the distal end portions of the upper and lower support members when coupled to the upper and lower support members.

22. The method of claim 21 wherein the inboard end portion is offset from the central hub by a distance of at least 12 inches.

23. The method of claim 21, further comprising:

disposing a central spacer between a first hub plate and a second hub plate such that the central spacer is positioned adjacent to a drive shaft opening of each of the first and second hub plates; and disposing a plurality of outer spacers between an outer periphery of each of the first and second hub plates.

24. The method of claim 21, further comprising coupling the inboard end portion of the fan blade to the second end portion of the strut.

25. A method of manufacturing a fan, the method comprising:

attaching a first retention member to a top side of a central hub, wherein the top side faces a first direction, wherein the central hub includes a bottom side facing a second direction, opposite to the first direction, and wherein the first retention member includes a first flange that at least partially surrounds a drive shaft opening of the central hub;

coupling the central hub to a drive shaft of a drive unit carried by a drive unit mount;

after coupling the central hub to the drive shaft, attaching at least one second retention member to the drive unit mount, wherein the at least one second retention member includes a second flange that extends between the central hub and the first flange of the first retention member;

positioning an outer portion of the central hub between an upper support member and a lower support member;

attaching a proximal end portion of the upper support member to the top side of the central hub;

attaching a proximal end portion of the lower support member to the bottom side of the central hub;

coupling an inboard end portion of a fan blade to a distal end portion of the upper support member; and coupling the inboard end portion of the fan blade to a distal end portion of the lower support member.

26. The fan of claim 25 wherein the first flange is an outward flange and the second flange is an inward flange.

27. The fan of claim 25 wherein the first flange extends in a first direction and the second flange extends in a second direction, opposite to the first direction.

* * * * *